US007410297B2

(12) United States Patent
Sundaram

(10) Patent No.: US 7,410,297 B2
(45) Date of Patent: Aug. 12, 2008

(54) APPARATUS FOR CONTROLLING RADIATION IN A RADIATION GENERATOR

(75) Inventor: Senthil Kumar Sundaram, Navi Mumbai (IN)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 11/675,952

(22) Filed: Feb. 16, 2007

(65) Prior Publication Data

US 2008/0043925 A1 Feb. 21, 2008

Related U.S. Application Data

(63) Continuation-in-part of application No. 11/465,571, filed on Aug. 18, 2006.

(51) Int. Cl.
*H01J 35/16* (2006.01)

(52) U.S. Cl. ..... 378/203; 378/101; 378/142

(58) Field of Classification Search ..... 378/101, 378/117, 119, 142, 203
See application file for complete search history.

(56) References Cited

U.S. PATENT DOCUMENTS

| | | | | |
|---|---|---|---|---|
| 4,573,103 | A | 2/1986 | Nilsson | |
| 4,748,104 | A | 5/1988 | Ferrier | |
| 6,212,076 | B1 | 4/2001 | MacQuarrie et al. | |
| 6,518,661 | B1 | 2/2003 | Blish, II et al. | |
| 6,619,842 | B1 | 9/2003 | Artig | |
| 6,888,922 | B2 * | 5/2005 | Schaefer et al. | 378/131 |
| 2003/0081727 | A1 | 5/2003 | Kandankumerath | |
| 2005/0018817 | A1 | 1/2005 | Oettinger | |

FOREIGN PATENT DOCUMENTS

| | | | |
|---|---|---|---|
| EP | 0920055 | B1 | 6/1999 |

* cited by examiner

*Primary Examiner*—Jurie Yun

(57) ABSTRACT

An apparatus to control transmission of an electromagnetic radiation generated by a radiation source of a radiation generator is provided. The radiation source includes an anode opposite a cathode. The apparatus comprises at least one printed circuit board assembly fastened at the anode of the radiation generator. The printed circuit board assembly comprises at least one first layer that includes a conduit to receive a mechanical device attaching the anode at the at least one first layer.

20 Claims, 7 Drawing Sheets

APPARATUS FOR CONTROLLING RADIATION IN A RADIATION GENERATOR

CROSS REFERENCE TO RELATED APPLICATIONS

This application is a continuation in part of U.S. application Ser. No. 11/465,571 filed on Aug. 18, 2006 and is hereby incorporated herein by reference in its entirety.

BACKGROUND OF THE INVENTION

The subject matter described herein generally relates to a radiation generator and more particularly to a radiation control apparatus configured to control radiation generated in a radiation generator.

Various types of radiation generators have been developed so as to generate electromagnetic radiation. The electromagnetic radiation thus generated can be utilized for various purposes including medical imaging. One such example of a radiation generator is an X-ray generator. A typical X-ray generator generally comprises an X-ray tube for generating electromagnetic radiation (For example, X-rays), a power supply circuit configured to energize the X-ray tube in a conventional manner so as to emit X-rays through a port and toward a target. Radiation shielding is provided around the X-ray port in order to prevent the X-rays from undesirably reaching the operator. Radiation shielding is usually performed with a shielding material that comprises a heavy metal material such as lead. The shielding material is mixed with an insulation to provide radiation shielding.

The power supply circuit of a conventional X-ray generator generally includes a high voltage conductor configured to supply high voltage power so as to energize the X-ray tube. In one scenario, a radiation shield is placed between the X-ray tube and the power supply circuit, and the high voltage conductor is passed through the radiation shield requiring a use of insulating material along with the shielding material. A high electrical stress exists between the high voltage conductor and the shielding material of the radiation shield as the high voltage conductor carrying a high voltage is placed at a close proximity to the shielding material maintained at a ground potential. The positioning and dimensional control of the shielding material is critical in keeping the electrical stress at a safe value. One drawback of these certain known radiation shields is the difficulty in controlling the dimensional variations and positioning of the lead material particularly when used on or along an insulating surface. This difficulty in controlling the placement of the lead material increases opportunities of undesired electrical arcing of the high voltage electrical power causing failure of the X-ray generator.

Another drawback of conventional radiation shields is the technical difficulty associated with grounding the heavy metal material such as lead when used on or along the insulating surface. The soldering process for grounding the lead is generally performed by exposing a part of the lead material to insulating oil often used in the X-ray generator, which increases the likelihood of contamination of the insulating oil. Both, the process of manufacturing a radiation shield i.e., placing the shielding material on or along the insulating surface and soldering the lead material to electrically ground the material are highly skilled operations.

Hence, there exists a need to provide a radiation shield that can be readily sourced and manufactured, while maintaining the insulating and radiation shielding properties.

BRIEF DESCRIPTION OF THE INVENTION

The above-mentioned needs are addressed by the subject matter described herein.

In one embodiment, an apparatus to control transmission of an electromagnetic radiation generated by a radiation source of a radiation generator is provided. The radiation source includes an anode opposite a cathode. The apparatus comprises at least one printed circuit board assembly fastened at the anode of the radiation source. The printed circuit board assembly comprises at least one first layer that includes a conduit to receive a mechanical device attaching the anode at the at least one first layer.

In another embodiment, a radiation generator is provided. The radiation generator comprises a radiation source operable to generate an electromagnetic radiation, a power supply circuit electrically coupled to provide electrical power to energize the radiation source and a radiation control apparatus configured to reduce transmission of electromagnetic radiation generated by the radiation source. The radiation control apparatus comprises at least one printed circuit board assembly fastened at the anode of the radiation source. The printed circuit board assembly comprises at least one first layer that includes a conduit to receive a mechanical device attaching the anode at the at least one first layer.

In yet another embodiment, an X ray generator is provided. The X ray generator comprises an X ray tube operable to generate electromagnetic radiation, a power supply circuit electrically coupled to provide electrical power to energize the X ray tube and a radiation control apparatus to reduce transmission of electromagnetic radiation generated by the X ray tube. The radiation control apparatus comprises at least one printed circuit board assembly fastened at the anode of the X ray tube. The printed circuit board assembly comprises at least one first layer that includes a conduit to receive a mechanical device attaching the anode at the at least one first layer.

Systems and methods of varying scope are described herein. In addition to the aspects and advantages described in this summary, further aspects and advantages will become apparent by reference to the drawings and with reference to the detailed description that follows.

DETAILED DESCRIPTION OF THE INVENTION

In the following detailed description, reference is made to the accompanying drawings that form a part thereof, and in which is shown by way of illustration specific embodiments, which may be practiced. These embodiments are described in sufficient detail to enable those skilled in the art to practice the embodiments, and it is to be understood that other embodiments may be utilized and that logical, mechanical, electrical and other changes may be made without departing from the scope of the embodiments. The following detailed description is, therefore, not to be taken in a limiting sense.

Figure 1:
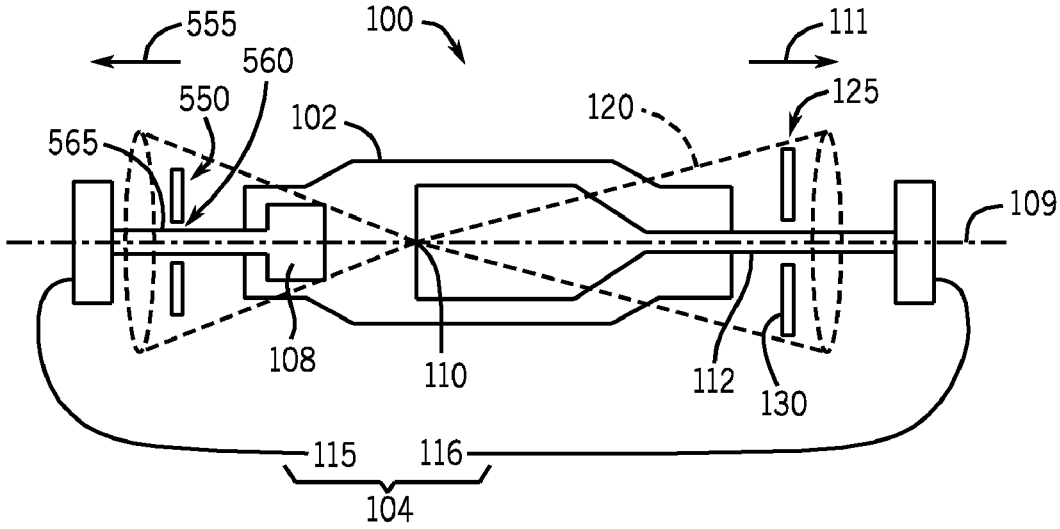
FIG. 1 shows a schematic diagram of an embodiment of a radiation generator having a radiation control apparatus that includes a printed circuit board.

FIG. 1 shows an embodiment of a radiation generator 100 that comprises a radiation source 102 configured to generate electromagnetic radiation. In the illustrated embodiment, the radiation generator 100 is an X-ray generator, and the radiation source 102 is an X-ray tube electrically coupled to a power supply circuit 104 so as to generate X-rays. The illustrated radiation source 102 generally includes a cathode 108 located, in general alignment along a central longitudinal axis 109 of the radiation source 102, opposite an anode 110.

The power supply circuit 104 generally includes one or more electrical components (e.g., diodes, capacitors, transformers, resistors, etc.) configured in a conventional manner to supply electrical power so as to cause the emission of electromagnetic radiation (e.g., X-rays) from the radiation source 102. The illustrated power supply circuit 104 includes a first power circuit portion 115 electrically connected to the anode 110, and a second power circuit portion 116 electrically connected to the cathode 108. The first power circuit portion 115 for the anode 110 is located directly behind the anode 110 in an axial outward direction 111 from the anode 110 of the radiation source 102 opposite the cathode 108. The second power circuit portion 116 is located in a similar manner behind the cathode 108. The first power circuit portion 115 of the power supply circuit 104 provides a high voltage potential to the anode 110. The high voltage potential provided to the anode 110 is in the range of 40 to 100 kilovolts. However, the value of the voltage potential can vary.

The cathode 108 generally includes an electron-emitting filament that is capable in a conventional manner of emitting electrons. The high voltage potential supplied by the power supply circuit 104 causes acceleration of electrons from the cathode 108 towards the anode 110. The accelerated electrons collide with the anode 110, producing X-ray radiation. The cathode 108 and the anode 110 reduce or partially attenuate the transmission of the electromagnetic radiation from the radiation source 102. A shadow zone 120 represents an example of an expected range of partially attenuated electromagnetic radiation. The illustrated zone 120 is generally conical shaped, but the shape of the shadow zone 120 may vary.

The radiation generator 100 further includes a radiation control apparatus 125 configured to at least reduce and control the transmission of the electromagnetic radiation from the radiation source 102. The radiation control apparatus 125 generally includes at least one printed circuit board 130 placed between the radiation source 102 and the first power circuit portion 115 of the power supply circuit 104, within the shadow zone 120 where partially attenuated electromagnetic radiation or scattered radiation are expected, so as to reduce further and control the transmission of the electromagnetic radiation. The printed circuit board 130 can be sized to extend entirely across or at least partially across the zone 120 in a plane perpendicular to the longitudinal axis 109 of the radiation source 102. Also, the location of the radiation control apparatus 125 relative to the radiation source 102 can vary.

Figure 2:
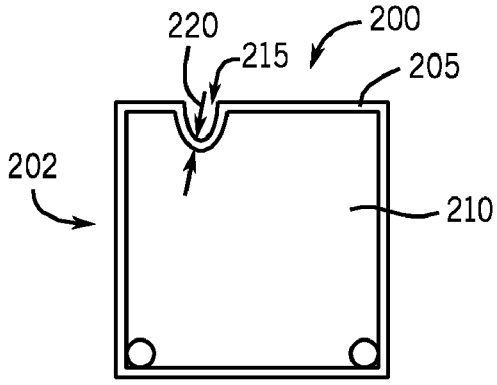
FIG. 2 shows a schematic diagram of an embodiment of a radiation control apparatus.

FIG. 2 provides a schematic diagram of one embodiment of a radiation control apparatus 200 comprised of a printed circuit board 202. The printed circuit board 202 includes a substrate layer 205 and a medium layer 210. The medium layer 210 can be bound to the substrate layer 205 using various processes, such as mechanical pressing, heating, pressurized spray, adhesives, or other conventional processes or combination thereof.

The substrate layer 205 is comprised of at least one insulating composition or a material selected from a group consisting of an epoxy compound, a urethane compound,, a ceramic, and a silicon-potting compound. For example, the substrate layer 205 can include an epoxy laminated glass cloth sheet, also referred to as FR4. Yet, other types of insulating materials can be employed.

The medium layer 210 is comprised of a radio opaque material comprising at least one of a metal, a compound of a metal (such as a metal oxide, metal phosphate and metal sulphate), and an alloy of a metal or combination thereof. The medium layer 210 can be readily etched or soldered, and selected from a group comprising tungsten, calcium, tantalum, tin, molybdenum, brass, copper, strontium, chromium, aluminum and bismuth or a combination or a compound or an alloy thereof. However, it is understood that the composition of the medium layer 210 is not limited to the examples given above.

The printed circuit board 202 further includes an opening or a conduit or a slot 215 which provides passage for a conductor 112 from the power supply circuit 104 for electrical connection at the anode 110 of the radiation source 102 (See FIG. 1). The location of the opening 215 on the printed circuit board 202 can vary. A creepage distance 220 of the substrate layer 205 is provided between the conductor 112 and the medium layer 210 so as to reduce and control electrical stress and the likelihood of undesired electrical arcing between the conductor 112 of the first power circuit portion 115 of the power supply circuit 104 and the medium layer 210 of the printed circuit board 202. The manufacturing process of the printed circuit board 202 allows enhanced dimensional control for the construction, and placement of the medium layer 210 on the substrate layer 205 relative to the conductor 112.

The medium layer 210 can be an exposed, external layer or an intermediate, enclosed layer. The conductor 112 (See FIG. 1) can be butted against or at least be closely adjacent to the substrate layer 205 of the printed circuit board 202, yet at a predetermined spaced distance from contact with the medium layer 210 of the printed circuit board 202 so as to reduce opportunities of undesired electrical arcing. Locating the medium layer 210 externally of the printed circuit board 202 in the axially outward direction 111 (See FIG. 1) from the radiation source 102 allows greater thicknesses of the medium layer 210 to be employed, enhancing the radiation shielding effectiveness so as to reduce and control the transmission of radiation through the printed circuit board 202.

The medium layer 210 of the printed circuit board 202 can be comprised of an integral, single layer or multiple layers of one or more radio opaque materials described above of varying thickness stacked together or overlapped in order to obtain a desired thickness of the medium layer 210 bound to the substrate layer 205. Although the illustrated medium layer 210 is bound at an external face of the substrate layer 205, it is understood that the subject matter described herein encompasses that the medium layer 210 can be bound externally or can be internally embedded in the substrate layer 205.

Figure 3:
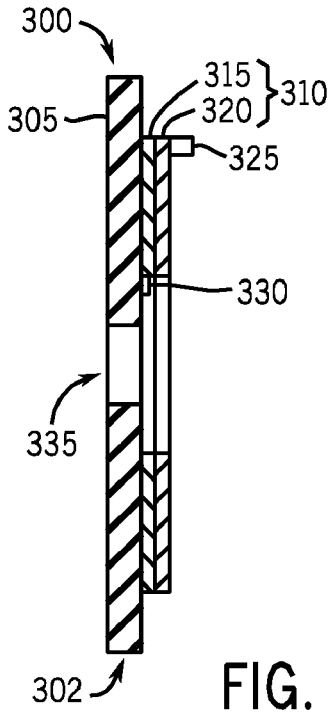
FIG. 3 shows a schematic diagram of another embodiment of a radiation control apparatus.

FIG. 3 illustrates another embodiment of a radiation control apparatus 300 that includes a printed circuit board 302 having a substrate layer 305 and a medium layer 310, similar in construction to the substrate layer 205 and the medium layer 210 of the printed circuit board 202 described above. The medium layer 310 is comprised of a series of medium layers 315 and 320 comprised of the same or a combination of radio opaque materials described above of varying thickness stacked together or at least partially overlapped in order to obtain a desired thickness of the medium layer 310. The medium layers 315 and 320 described above facilitate the mounting of one or more standard connectors 325 and 330 (e.g., clips, screws, etc.) configured to simplify the task of providing electrical or mechanical connections to the printed circuit board 302. The standard connectors 325 and 330 are configured to provide electrical connection to the conductor 112 (See FIG. 1), to extend electrical connections, or to provide electrical ground connections through the printed circuit board 300. For example, the conductor 112 (See FIG. 1) or portion thereof can extend through an opening 335, constructed similar to the opening 215 described above. The conductor 112 (See FIG. 1) can be electrically connected via the standard connectors 325 and 330 so as to provide electrical power from the first power circuit portion 115 of the power supply circuit 104 to the radiation source 102 (e.g., the X-ray tube). Each of the standard connectors 325 and 330 can be mounted on a same or at different medium layers 315 and 320. The location and type of the standard connectors 325 and 330 can vary. Also, although two medium layers 315 and 320 are shown, the number of the medium layers can vary.

Figure 4:
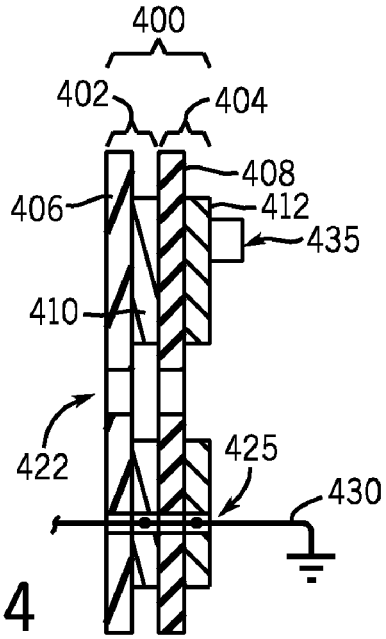
FIG. 4 shows a schematic diagram of yet another embodiment of a radiation control apparatus.

FIG. 4 illustrates another embodiment of a radiation control apparatus 400 comprised of multiple printed circuit boards 402 and 404. The printed circuit boards 402 and 404 are comprised of at least one substrate layer 406 and 408 and at least one medium layer 410 and 412, respectively, of varying thickness assembled together in various fashions to obtain a desired thickness, similar in construction to substrate layer 205 and medium layer 210 of the printed circuit board 202 described above. The at least one substrate layer 406 is arranged as an insulating surface facing and located nearest the radiation source 102. Constructing the radiation control apparatus 400 comprised of multiple printed circuit boards 402 and 404 such that the multiple medium layers 410 and 412 are separated by the substrate layers 406 and 408, respectively, allows each of the medium layers 410 and 412 to be maintained at a voltage potential different from one another and/or at a voltage potential different from an electrical ground. In addition to an opening 422 similar in construction to the opening 215 described above, to receive the conductor 112 therethrough, at least one of the printed circuit boards 402 and 404 includes at least one opening or point through hole (PTH) 425 configured to provide electrical or mechanical connection to one or more of the medium layers 410 and 412. For example, an electrical ground connection 430 can be received through the opening 425 for electrical connection to one or both of the medium layers 410 and 412 of the multiple printed circuit boards 402 and 404. An embodiment of the PTHs 425 include a plate of electrically conductive material extending at least partially around a circumference of the PTHs 425 so as to provide electrical connection to the medium layers 410 and 412.

Still referring to FIG. 4, either of the printed circuit boards 402 and 404 can be mounted with one or more electrical components 435 (e.g., diodes, capacitors, resistors, transformers, etc.) of the first power circuit portion 115 of the power supply circuit 104 (See FIG. 1). It should be understood that the number and types of the electrical components 435 can vary. In addition to providing radiation shielding, the printed circuit boards 402 and 404 can be configured to provide electrical shielding so as regulate stray capacitance across one or more of the electrical components 435 mounted on the printed circuit boards 402 and 404.

Figure 5:
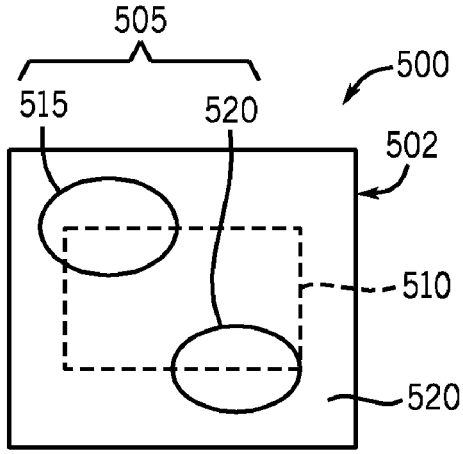
FIG. 5 shows schematic diagram of yet another embodiment of a radiation control apparatus.

FIG. 5 illustrates another embodiment of a radiation control apparatus 500 that includes a printed circuit board 502 comprised of multiple medium layers 505 and 510. A single medium layer 505 comprises multiple medium regions 515 and 520 that lie generally along a single plane perpendicular to the longitudinal axis 109 (See FIG. 1), yet spaced apart such that each can be at a different voltage potential from one another and/or at a different voltage potential from the electrical ground. The medium layer 510 is aligned in a plane spaced at a distance (e.g., by air, oil or a substrate layer 525) from the medium regions 515 and 520 of the medium layer 505. Yet, as shown in FIG. 5, each of the medium regions 515 and 520 are located in partial overlapping distribution relative to the medium layer 510 in looking in the axial outward direction 111 from the radiation source 102 (See FIG. 1). This embodiment of the radiation control apparatus 500 enhances electromagnetic radiation shielding while also allowing for multiple voltage potentials at the printed circuit board 502. It should be understood that the number and arrangement of the medium regions 515 and 520 at one or more of the medium layers 505 and 510 can vary.

Referring back to FIG. 1, a radiation control apparatus 550 can also be located in an axial outward direction (illustrated by arrow and reference 555) from the cathode 108 of the radiation source 102, similar to the radiation control apparatus 200. The radiation control apparatus 550 can be constructed and operated in a manner similar to one or more of the embodiments of radiation control apparatuses 200, 300, 400, and 500 or combination thereof described above. The radiation control apparatus 550 includes at least one opening 560, constructed in a manner similar to the opening 215 described above, configured to receive a conductor 565 from the second power circuit portion 116 to the cathode 108.

Figure 6:
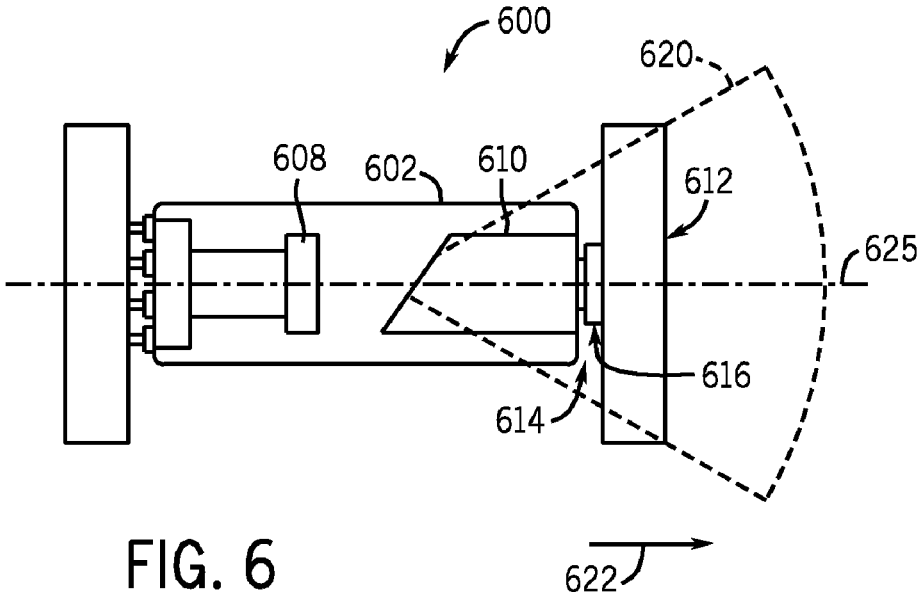
FIG. 6 shows a schematic diagram of another embodiment of a radiation generator having a radiation control apparatus that includes a multiplier circuit board.

FIG. 6 illustrates another embodiment of a radiation generator 600 that comprises a radiation source 602 (e.g., an X-ray tube) having a cathode 608 and anode 610 in combination with a power supply circuit 612 and a radiation control apparatus 614, similar to the radiation generator 100 described above. The radiation control apparatus 614 includes a multiplier circuit board 616 configured to reduce and control transmission of the electromagnetic radiation. The multiplier circuit board 616 is located within a shadow zone 620 representative of an expected range of attenuation of electromagnetic radiation, similar to the location of the printed circuit board 130 in the shadow zone 120 of the radiation generator 100 described above. The multiplier circuit board 616 is also located in an axially outward direction (shown by arrow and reference 622) from the anode 610 along a longitudinal axis 625 of the radiation source 602. Again, it should be understood that the multiplier circuit board 616 can be placed at other locations (e.g., axially outward of the cathode 608 opposite the radiation source 602) and can vary in size and shape.

Figure 7:
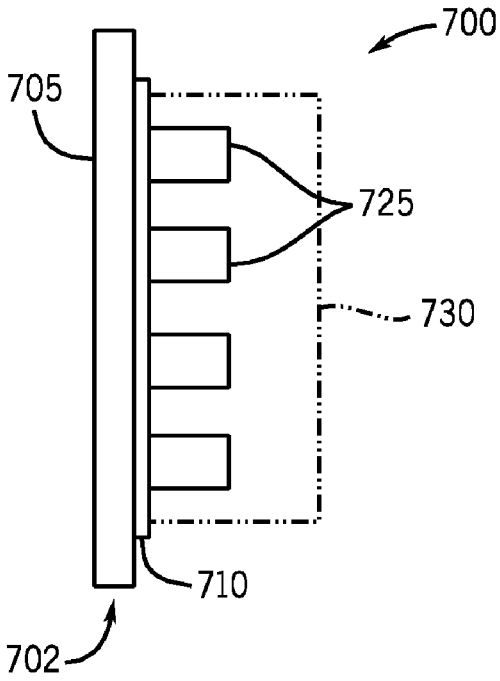
FIG. 7 shows a schematic diagram of an embodiment of the multiplier circuit board.

FIG. 7 shows a schematic diagram of an embodiment of a radiation control apparatus 700 that includes a multiplier circuit board 702. The multiplier circuit board 702 generally comprises at least one substrate layer 705, at least one medium layer 710 bound to the substrate layer 705, and multiple electrical components 725 of a multiplier circuit 730 electrically connected as part of or in addition to the power supply circuit 612 (See FIG. 6) in a manner so as to expand a range of voltage potentials communicated to the radiation source 602 of the radiation generator 600 (See FIG. 6). The electrical components 725 are attached in electrical connection with the at least one medium layer 710. In addition to enhancing radiation shielding, the multiplier circuit board 702 also enhances electrical shielding so as regulate electrical stray capacitance across the electrical components 725 of the multiplier circuit board 702.

Although FIG. 7 shows the multiplier circuit board 702 having a single medium layer 710, it is understood that the number of medium layers can vary, similar to the construction of the printed circuit board 202 described above. Also, although a single multiplier circuit board 702 is referenced and illustrated having the substrate layer 705 bound to the medium layer 710, it is understood that the radiation control apparatus 700 encompasses being comprised of multiple multiplier circuit boards 702 each having one, or more substrate layers 705 separating one or more medium layers 710, so as to be able to maintain a voltage potential at one or more of the multiple medium layers 710 that is different from one another and/or different from the electrical ground, similar to the construction of the printed circuit board 402 described above. Likewise, the at least one medium layer 710 of the multiplier circuit board 702 can be comprised of multiple medium regions aligned along the same general plane and yet separated apart by the substrate layer 705 in varying arrangements and fashions of construction (e.g., partial overlapping distribution, uniform stacked alignment, etc.), similar to the construction of the printed circuit board 502 described above.

Figure 8:
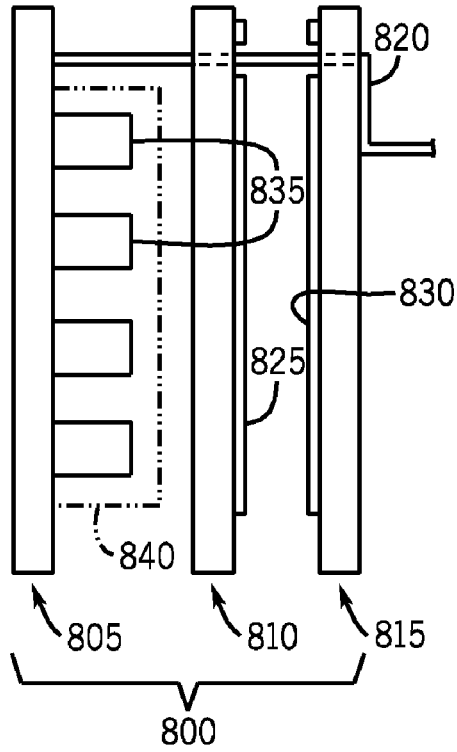
FIG. 8 shows a schematic diagram of an embodiment of a radiation control apparatus that includes a multiplier circuit board in combination with a printed circuit board.

FIG. 8 shows another embodiment of a radiation control apparatus 800 that includes at least one multiplier circuit board 805 combined with multiple printed circuit boards 810 and 815. The multiplier circuit board 805 is similar in construction to the multiplier circuit boards 616 and 702 described above. Likewise, the printed circuit boards 810 and 815 are similar in construction to the printed circuit boards 130, 202, 302, 402, and 502 described above and configured for reducing and controlling the emission or transmission of the electromagnetic radiation. A conductor 820 electrically connects the power supply circuit 612 (See FIG. 6) and the radiation source 602 (See FIG. 6) in a manner as described above. The conductor 820 extends from the multiplier circuit board 805 through the printed circuit boards 810 and 815 for electrical connection at the radiation source 602 (See FIG. 6). Standard connectors 325 (See FIG. 3) can be provided to electrically connect the conductor 820 to one or more of the multiplier circuit board 805 and printed circuit boards 810 and 815. Medium layers 825 and 830 of the printed circuit boards 810 and 815, respectively, are oriented so as to face toward one another along the central longitudinal axis 109 (See FIG. 1). This configuration of the radiation control apparatus 800 not only enhances insulation and radiation shielding, but also controls communication of undesired stray electrical capacitance across electrical components 835 of a multiplier circuit 840 mounted at the multiplier circuit board 805. Again, it is understood that the number of multiplier circuit boards 805 and printed circuit boards 810 and 815 can vary.

Figure 9:
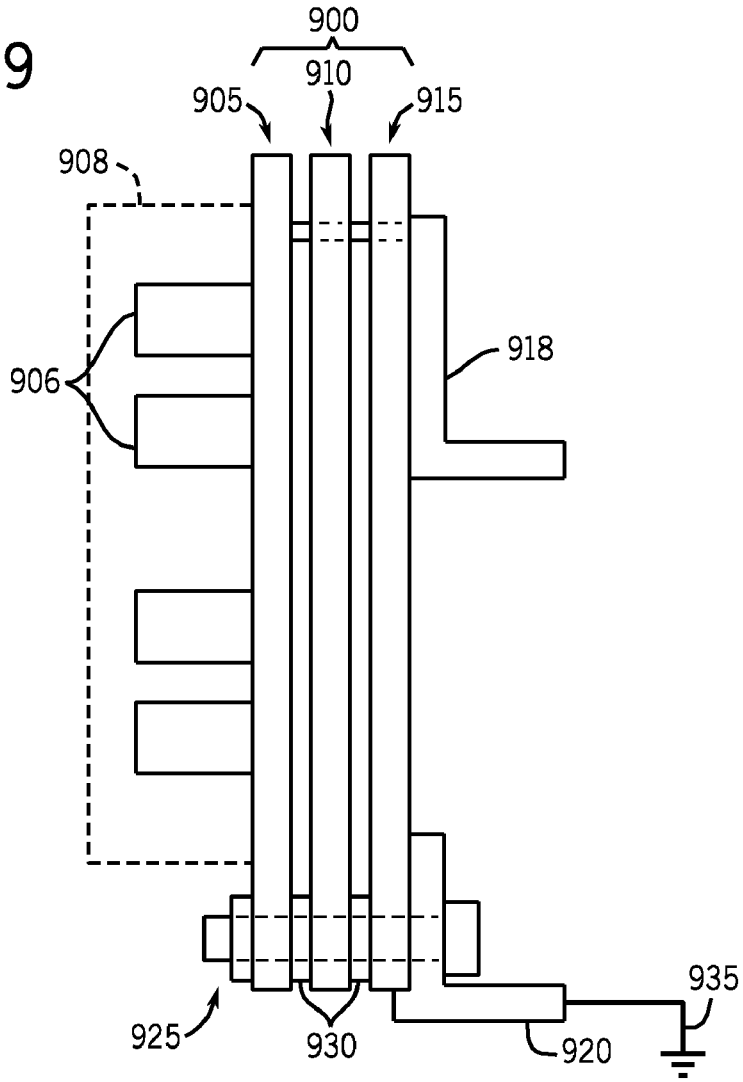
FIG. 9 shows a schematic diagram another embodiment of a radiation control apparatus that includes a multiplier circuit board in combination with a printed circuit board.

FIG. 9 shows another embodiment of a radiation control apparatus 900 which includes at least one multiplier circuit board 905 with miscellaneous electrical components 906 (e.g., a split resistor, a high voltage (HV) resistor divider, and diodes of variable value) of a multiplier circuit 908, similar in construction to the multiplier circuit boards 616 and 702 described above, in combination with printed circuit boards 910 and 915, similar in construction to the printed circuit boards 130, 202, 302, 402, and 502 described above. A conductor 918 extends from the multiplier circuit board 905 through the printed circuit boards 910 and 915 so as to provide electrical power from the power supply circuit 612 (See FIG. 6) to the radiation source 602 (See FIG. 6). A metallic leg 920 in combination with a fastener 925 (e.g., bolt and nut) secures the multiplier circuit board 905 to the printed circuit boards 910 and 915. One or multiple washers 930 are located as spacers to provide separation between the at least one multiplier circuit board 905 and/or the printed circuit boards 910 and 915. The washers 930 also electrically connect one or more of the medium layers of the at least one multiplier circuit board 905 and printed circuit boards 910 and 915 to an electrical ground connection 935.

Still referring to FIG. 9, one or more of the miscellaneous electrical components 906 of the multiplier circuit 908 and/or the power supply circuit 612 (See FIG. 6) can be mounted in electrical connection on at least one of the printed circuit boards 910 and 915. The printed circuit boards 910 and 915 provide enhanced electrical shielding by regulating electrical stray capacitance across the electrical components 906. Moving one or more electrical components 906 of the multiplier circuit 908 and/or the power supply circuit 612 from the at least one multiplier circuit board 905 to one or more of the printed circuit boards 910 and 915 can also reduce the density, and thereby improve the associated thermal efficiency, of the radiation control apparatus 900.

Various embodiments of radiation control apparatuses 125, 200, 300, 400, 500, 614, 700, 800 and 900 configured to reduce, shield or control emission or transmission of electromagnetic radiation are described above in combination with radiation generators 100 and 600 having a radiation source 102 and 602, respectively. Although embodiments of the location of the radiation control apparatuses 125, 200, 300, 400, 500, 614, 700, 800 and 900 are shown, the embodiments are not so limited and the location of the radiation control apparatuses 125, 200, 300, 400, 500, 614, 700, 800 and 900 relative to the radiation source 102 and 602 can vary. Also, the embodiments of the radiation control apparatuses 125, 200, 300, 400, 500, 614, 700, 800 and 900 may be implemented in connection with different applications. The application of the radiation control apparatuses 125, 200, 300, 400, 500, 614, 700, 800 and 900 in radiation shielding can be extended to other areas or types of radiation generators. The radiation control apparatuses 125, 200, 300, 400, 500, 614, 700, 800 and 900 described above provide a broad concept of shielding various types of electromagnetic radiation. Further, the radiation control apparatuses 125, 200, 300, 400, 500, 614, 700, 800 and 900 can be used for mounting of miscellaneous electrical components 435, 725, 835 and 906 and in the regulation of stray capacitance across the miscellaneous electrical components 435, 725, 835 and 906, which can be adapted in various types of radiation generators 100 and 600.

Figure 10:
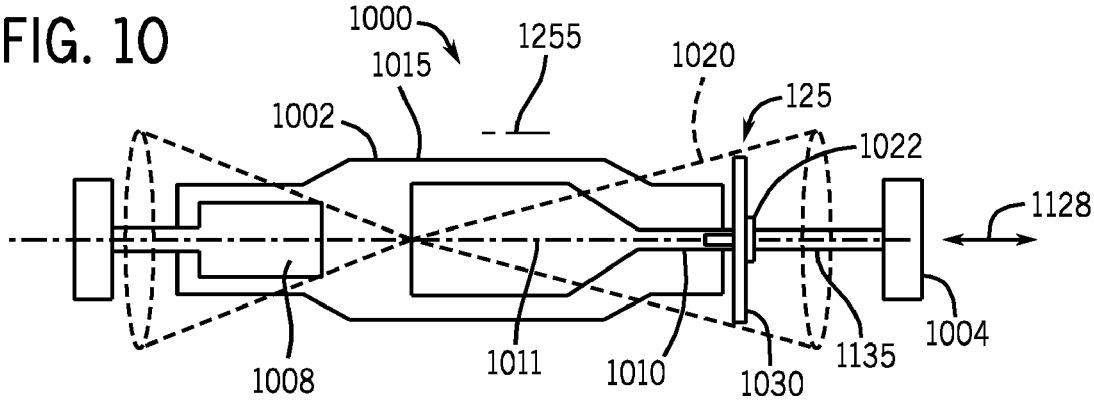
FIG. 10 shows a schematic diagram of an embodiment of a radiation generator having a radiation control apparatus that includes a printed circuit board assembly attached at anode of the radiation generator.

FIG. 10 shows a schematic diagram of another embodiment of a radiation generator 1000. In the illustrated embodiment, the radiation generator 1000 is an x-ray generator, and the radiation source 1002 is an x-ray tube electrically coupled to a power supply circuit 1004 so as to generate x-rays. The illustrated radiation source 1002 generally includes a cathode 1008 located, in general alignment along a central longitudinal axis 1011 of the radiation source 1002 opposite an anode 1010. The radiation generator 1000 also includes a housing 1015 generally enclosing the radiation source 1002.

The power supply circuit 1004 generally includes one or more electrical components (e.g., diodes, capacitors, transformers, resistors, etc.) configured in a conventional manner to supply electrical power so as cause the emission of electromagnetic radiation (e.g., x-rays) from the radiation source 1002.

The cathode 1008 generally includes an electron-emitting filament that is capable in a conventional manner of emitting electrons. The high voltage potential supplied by the power supply circuit 1004 causes acceleration of electrons from the cathode 1008 towards the anode 1010. The accelerated electrons collide with the anode 1010 producing electromagnetic radiation including x-ray radiation. The cathode 1008 and anode 1010 reduce or partially attenuate the transmission of the electromagnetic radiation from the radiation source 1002. A shadow zone 1020 represents an example of an expected range of partially attenuated electromagnetic radiation. The illustrated shadow zone 1020 is generally conical shaped, but the shape of the shadow zone 1020 may vary. The placement of the power supply circuit 1004 in the shadow zone 1020 is desired as the electrical components (not shown) forming a part of the power supply circuit 1004 get exposed to the attenuated electromagnetic radiation.

The radiation generator 1000 further includes a radiation control apparatus 1025 configured to at least reduce and control the transmission of the electromagnetic radiation from the radiation source 1002. An embodiment of radiation control apparatus 1025 includes at least one printed circuit board assembly 1030 placed between the radiation source 1002 and the power supply circuit 1004 within the shadow zone 1020 where partially attenuated electromagnetic radiation or scattered radiation exists, so as to reduce further and control the transmission of the electromagnetic radiation. The printed circuit board assembly 1030 can be sized to extend entirely across or at least partially across the shadow zone 1020 in a plane perpendicular to the longitudinal axis 1011 of the radiation source 1002. The illustrated radiation control apparatus 1025 also is mounted by and rigidly supports the anode 1010 of the radiation source 1002 in relation to the radiation generator 1000. Thus, the radiation control apparatus 1025 removes the need for an additional mounting bracket assembly in the valuable, small real estate space of the radiation generator 1000.

Figure 11:
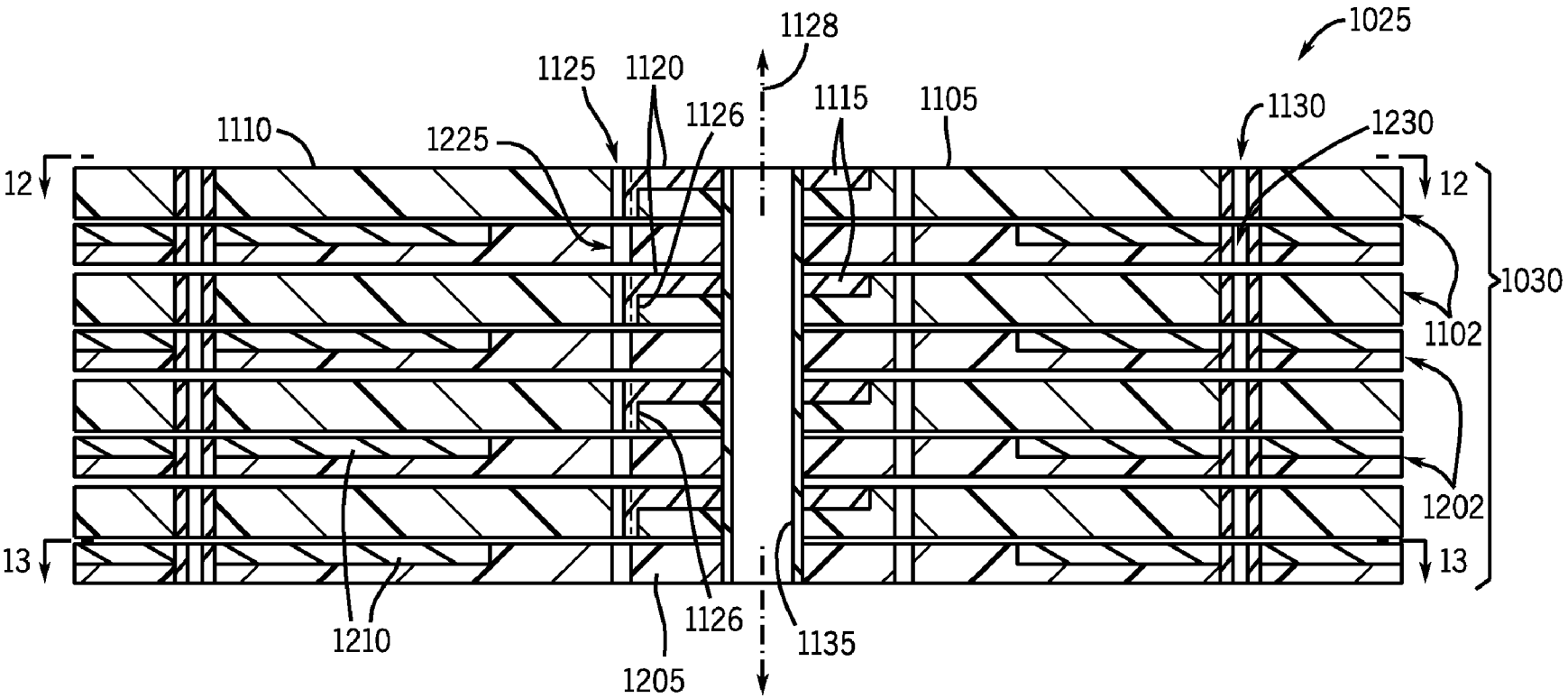
FIG. 11 shows a detailed schematic diagram of a cross-section view of the radiation control apparatus of FIG. 10.

FIG. 11 illustrates an embodiment of the printed circuit board assembly 1030. The printed circuit board assembly 1030 comprises at least one first layer 1102 bound to at least one second layer 1202 in stacked manner and configured to mount the anode 1010 of the radiation source 1002 in a fixed manner. The anode 1010 of the x-ray tube 1002 is fixed at the printed circuit board assembly 1030 using a mechanical device 1022 (See FIG. 10). Further, multiple electrical connections from the power supply circuit 1004 can be provided at the opposite surface of the printed circuit board assembly 1030. The anode 1010 is electrically connected at one side of the printed circuit board assembly 1030 nearest the radiation source 1002 (e.g., the x-ray tube) in electrical communication to receive electrical power via the printed circuit board assembly 1030 from the power supply circuit 1004, electrically connected at the opposite side of the printed circuit board assembly 1030. The printed circuit board assembly 1030 comprises multiple electrically conductive elements (e.g., tracks, coatings, liners, connectors etc.,) to transfer electrical power from the power supply circuit 1004 to the anode 1010 of the radiation source 1002.

Still referring to FIG. 11, the printed circuit board assembly 1030 comprises a construction of at least one first layer 1102 (FIG. 11) and at least one second layer 1202 (FIG. 12) bound to one another. The first layer 1102 can be bound to the second layer 1202 using various processes, such as mechanical pressing, heating, pressurized spray, adhesives, or other conventional processes or combination thereof. Of course, it should be understood that the number of first layers 1102 and the second layers 1202 comprising the printed circuit board assembly 1030 can vary.

Figure 12:
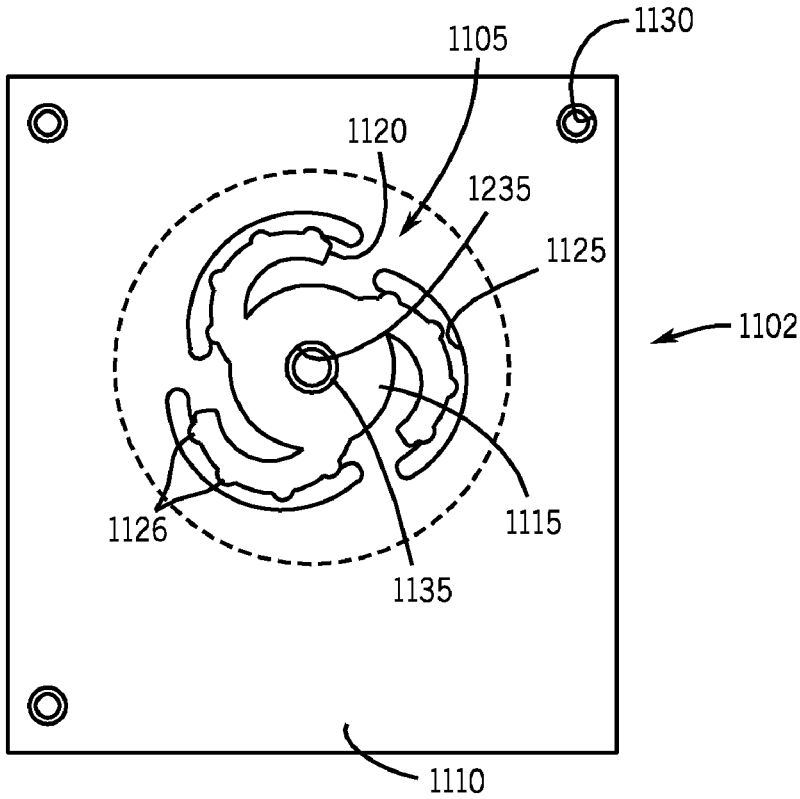
FIG. 12 shows a schematic diagram of an embodiment of a first layer of the radiation control apparatus of FIG. 11.

Referring now to FIG. 12, an embodiment of the first layer 1102 generally comprises a first core part 1105 and a first peripheral part 1110 located radially outward relative to and surrounding the first core part 1105. The second layer 1202 generally comprises a second core part 1205 and a second peripheral part 1210 located radially outward from the second core part 1205. This is further discussed in reference to FIG. 13.

Referring now to FIGS. 11-12, an embodiment of the first core part 1105 includes a central part 1115 that at least generally surrounds a conduit 1135 extending through the first layer 1102. The first core part 1105 further includes at least one radial extension 1120 electrically and mechanically connected to, and extending radially outward from, the central part 1115. As shown in FIG. 11, the radial extensions 1120 can be constructed integral with the central part 1115. The first core part 1105 may also include at least one slot 1125 extending through the first core part 1105. As illustrated in FIG. 11, each radial extension 1120 is connected to one or more longitudinal extensions 1126 (e.g., circumferential plate, linear strip, etc.) that couple with and may extend at least partially through each slot 1125 in the first layer 1102 in a direction parallel to a central longitudinal axis 1128 of the radiation source 1002 (See FIG. 10). The central part 1115 of the first core part 1105 is configured to be electrically and mechanically connected to the anode 1010 (See FIG. 10), such that the voltage potential at the central part 1115 is generally equal to the voltage potential at the anode 1010. An embodiment of the first peripheral part 1110 includes one or more plated point through holes (PPTHs) 1130 extending therethrough.

Figure 13:
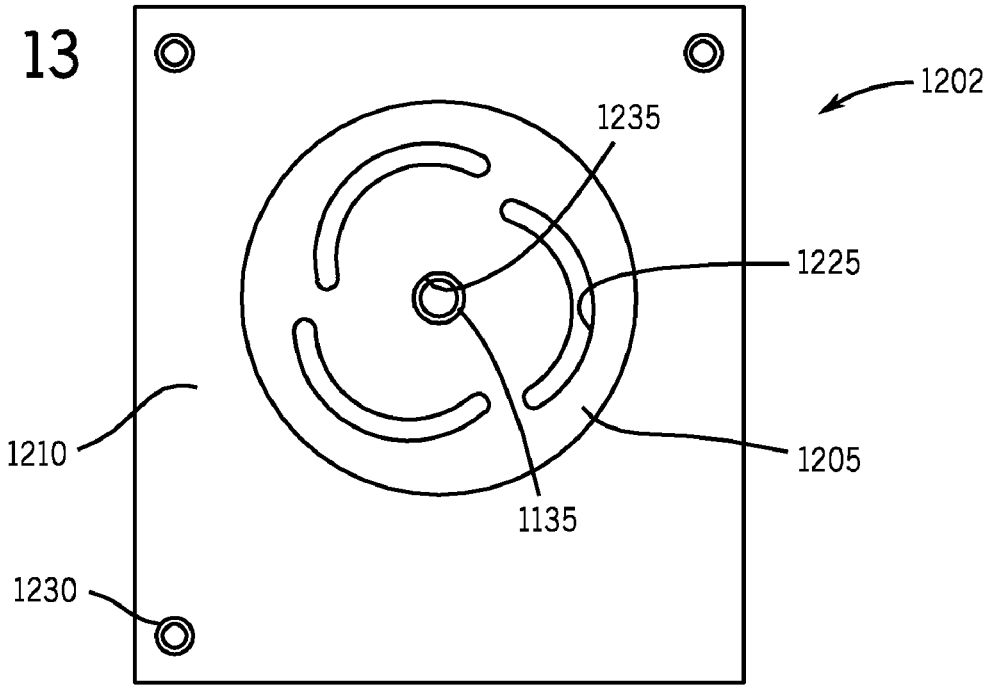
FIG. 13 shows a schematic diagram of an embodiment of a second layer of the radiation control apparatus of FIG. 11.

Referring to FIGS. 11 through 13, an embodiment of the second core part 1205 of the second layer 1202 includes a continuation of the conduit 1135 (See FIG. 11) and multiple slots 1225 extending through the second layer 1202 in the longitudinal direction 1128, in general longitudinal alignment with the respective conduit 1135 and multiple slots 1125 of the first layer 1102. An embodiment of the second peripheral part 1210 can also include multiple plated point through holes (PPTHs) 1230 extending therethrough in general longitudinal alignment with PPTHs 1130 extending through the first layer 1102. The size, shape and number of slots 1125 and 1225 and PPTHs 1130 and 1230 can vary.

The first peripheral part 1110 of the first layer 1102 (FIG. 12) and the second core part 1205 of the second layer 1202 (FIG. 13) are generally comprised of a substrate material of generally poor thermal and electrical conductivity. Examples of the substrate material include an epoxy-laminated glass (e.g., FR4), epoxy laminated paper, ceramic and polyamide.

Still referring to FIGS. 11-13, the central part 1115, multiple radial extensions 1120, and multiple longitudinal extensions 1126 comprising the first core part 1105 of the first layer 1102, as well as the second peripheral part 1210 of the second layer 1202, are comprised of at least one type of medium(s) of generally good electrical and thermal conductive materials. Yet, the first core part 1105 can comprise a first type of conductive medium and the second peripheral part 1210 can comprise a second type of conductive medium different than the first medium. Examples of good electrical and thermal conductive materials include a metal selected from a group consisting of copper, molybdenum, gold and copper composites or combinations thereof.

The first core part 1105 of the first layer 1102 and the second peripheral part 1210 of the second layer 1202 are also adapted to shield or at least reduce transmission of electromagnetic radiation scatter from the radiation source 1002. For example, adapting the second peripheral part 1210 to cover a larger portion of the second layer 1202 relative to the second core part 1205 enhances control of radiation scatter. In another example, control of radiation scatter is enhanced by designing the second peripheral part 1210 in the second layer 1202 to cover out an entire perimeter (e.g., the four edges) of the printed circuit board assembly 1030, in close proximity to the housing 1015 of the radiation generator 1000. The radiation control apparatus 1025 also allows selective control of radiation scatter through selective construction of a thickness of the medium comprising the second peripheral part 1210 of the second layer 1202. For example, radiation scatter through the radiation control apparatus 1025 can be selectively reduced by selectively increasing a number of the second layers 1202 of the printed circuit board assembly 1030.

The embodiment of the second peripheral part 1210 (FIG. 13) is configured to be in close proximity to the housing 1015 (FIG. 10). The housing 1015 is generally maintained at ground potential. To reduce a possibility of electric arcing between the second peripheral part 1210 of the second layer 1202 of the printed circuit board assembly 1030 and the housing 1015, the second peripheral part 1210 is also generally maintained at the ground potential.

As noted above, the first core part 1105 is generally maintained at the high voltage potential. To reduce a possibility of electrical arcing from the first core part 1105 to the second peripheral part 1210, the first core part 1105 and the second peripheral part 1210 are electrically isolated from one another. The first core part 1105 and the second peripheral part 1210 are located at different layers 1102 and 1202, respectively, of the printed circuit board assembly 1030. A physical space between each layer 1102 and 1202 provides the desired electrical insulation and isolation of the first core part 1105 from the second peripheral part 1210.

FIG. 11 generally illustrates a schematic diagram of the printed circuit board assembly 1030 comprising both the first layer 1102 and the second layer 1202 which simultaneously provide both electrical and thermal conductivity. Further, at least a portion of the second peripheral part 1210 of the plurality of second layers 1202 can be connected to a single voltage potential, such as a ground potential, through the provision of the multiple PPTHs 1230 located in the second peripheral part 1210. An embodiment of each PPTH 1230 includes an outer circumference plated with a metal, such as copper, that defines the diameter of the PPTHs 1230. The diameter of each PPTH 1230 can range from about 2 mils to about 40 mils. The depth of the PPTHs 1230 can extend only partially through the printed circuit board assembly 1030, or can extend through an entire thickness of the printed circuit board assembly 1030.

By selectively varying the thickness of the second medium in the second peripheral part 1210, the printed circuit board assembly 1030 can be configured to effectively absorb scattered radiation from the radiation source 1002. The central part 1115 and the second peripheral part 1210 of the printed circuit board assembly 1030 can be comprised of an integral layer or multiple layers of one or more electrically and thermally conductive materials (e.g., metal such as copper) described above of varying thickness stacked together or overlapped in order to obtain a desired thickness of the medium.

Referring now to FIGS. 10-13, in addition to using the radiation control apparatus 1025 for mounting the anode 1010 of the radiation source 1002 (FIG. 10), the printed circuit board assembly 1030 of the radiation control apparatus 1025 also enhances dissipation of heat generated by the radiation source 1002. The central part 1115 and the radial extensions 1120 of the first core part 1105 in each first layer 1102 are comprised of a medium of material that readily conducts heat. Also, the shape of the radial extension 1120 coupled to the central part 1115 increases a total surface area to aid in the dissipation of heat generated in the radiation source 1002. As shown in FIGS. 11 and 12, an embodiment of the radial extensions 1120 are generally shaped as finger-like projections that extend radially outward from the central part 1115 and in a general parallel alignment with the extended length of the slots 1125. An embodiment of the longitudinal extensions 1126 may also extend through one or more slots 1225 of the second layer 1202 so as to extend partially or an entire longitudinal length of the printed circuit board assembly 1030. Yet, it should be understood that the shape (e.g., fins) of each extensions 1120 and 1126 can vary. Further, each printed circuit board assembly 1030 can comprise multiple first layers 1102 in order to increase the total surface area to aid in dissipation of the heat. Further, in an exemplary embodiment, each of the second layers 1202 can be placed in various continuous or alternative fashions or arrangements with respect to the plurality of first layers 1102.

Referring now to FIG. 11, each of a series of the first layer 1102 can be electrically connected by the conduit 1135 (FIG. 10) to at least one other layer 1102. A circumferential wall of the conduit 1135 can be comprised of an electrically conductive material (e.g., a metal such as copper) that provides an electrical pathway between each of the series of layers 1102 and 1202.

In a similar fashion and as shown in FIG. 11, each of the series of first layers 1102 can be thermally conductive with one another via one or more of the slots 1125 and 1225, and the PPTHs 1130 and 1230. Accordingly, selective arrangement of the slots 1125 and 1225 and the PPTHs 1130 and 1230 promotes effective heat removal from the anode 1010 (FIG. 10) via the physical space between layers 1102 and 1202 and the peripheral parts 1110 and 1210 to the environment.

An embodiment of one or more of the conduit 1135, the longitudinal extensions 1126, the PPTHs 1130 and 1230 can be comprised of, coated or lined with a medium layer comprised of thermally as well as electrically conductive material. Thereby, thermally conductive conduit 1135, longitudinal extensions 1126, and PPTHs 1130 and 1230 enhance thermal conduction through the multiple layers 1102 and 1202 of the printed circuit board assembly 1030. Also, the electrically conductive PPTHs 1230 can provide electrical connection of the second peripheral part 1210 of one or more of the second layers 1202 to an electrical ground 935 (FIG. 9). The relative length (e.g., partial or entire) of the conduit 1135, longitudinal extensions 1126, and PPTHs 1130, 1230 through the printed circuit board assembly 1030 can vary.

Referring to FIGS. 11-13, to reduce a possibility of electrical arcing between a high voltage potential at the radial extensions 1120 or the longitudinal extensions 1126 and the ground potential at the second peripheral part 1210, the radial and longitudinal extensions 1120 and 1126, respectively, are located along a radially inward edge of the multiple slots 1125 of the first layer 1102. Also, the multiple slots 1125 in the first core part 1105 of the first layer 1102 are generally aligned in parallel relative to the longitudinal axis 1128 (See FIGS. 10 and 11) with the multiple slots 1225 in the second core part 1205 so as to run through the multiple layers 1102 and 1202 of the printed circuit board assembly 1030. The alignment of the run of multiple slots 1125 and 1225 through the multiple layers 1102 and 1202, respectively, increases the spaced distance and insulation between the radial and longitudinal extensions 1120 and 1126 and the second peripheral part 1210, thereby decreasing the possibility of electrical arcing between one another.

An amount of thermal flux carried by the extensions 1120 is generally higher compared to the other components of the printed circuit board assembly 1030. In order to enhance transfer of the thermal flux from each radial extension 1120 to the environment, a thermal conductive fluid medium 1255 (e.g., insulating oil) (See FIG. 10) flows through the slots 1125 and 1225 into contact with each of the radial extensions 1120. The radial extensions 1120 are shaped so as to increase surface contact with, and thereby increase thermal flux transfer with, the fluid medium 1255 for dissipation to the environment. The slots 1125 can be shaped as tubular holes, trenches, apertures or various other shapes to maximize heat absorption by the fluid medium 1255 without compromising on creepage. Creepage is the desired physical space between the longitudinal extensions 1126 and the, second peripheral part 1210. In general, creepage controls the electrical stress caused by the difference in electrical potential between the longitudinal extensions 1126 maintained at the high voltage potential and the second peripheral part 1210 maintained at the ground potential. The series of slots 1125 are coupled to the multiple extensions 1120 and 1126 of the first core part 1105, and run in general longitudinal alignment with the slots 1225 of the second layer 1202 so as to facilitate flow of the fluid medium 1255 through multiple layers 1102 and 1202 of the printed circuit board assembly 1030.

As shown in FIGS. 10-13, the longitudinal extensions 1126 are generally located at the radially outward edge of the radial extensions 1120 and extend along a length of the slot 1125 so as to come in direct contact with the fluid medium 1255 flowing through the slots 1125. The longitudinal extensions 1126 act as thermal conductors in dissipating heat via the fluid medium 1255. The dissipation of heat is selectively regulated by the number of longitudinal extensions 1126 coupled per radial extension 1120. Increasing the number of longitudinal extensions 1126 per radial extension 1120 increases the contact area to exchange thermal flux with the fluid medium 1255 flowing through the slots 1125.

In another embodiment, one or more electrical components 360 (See FIG. 2) and 365 (See FIG. 3) can be mounted at one or both of the first layer 1102 (FIG. 12) and the second layer 1202 (FIG. 14), respectively, of the printed circuit board assembly 1030. Examples of electronic components 360 and 365 include miscellaneous components of the power supply circuit 1004 (FIG. 10), including high voltage resistors, diodes and capacitors. The electrical components 360 and 365 shown in FIGS. 2 and 3 can be soldered in electrical connection to the conduit 1130 and PPTHs 1230 shown in FIG. 11, or to pads or other electrical conductors (e.g., the electrically conductive medium of the central part 1115 (FIG. 12), the electrically conductive medium of the second peripheral part 1210 (FIG. 13), etc.) of the printed circuit board assembly 1030. It should be understood that the number and types of the electrical components 360 and 365 (FIGS. 2 and 3) can vary. In addition to providing radiation shielding, the printed circuit board assembly 1030 can be configured to regulate stray capacitance across one or more of the electrical components 360 and 365 mounted on the printed circuit board assembly 1030.

Figure 14:
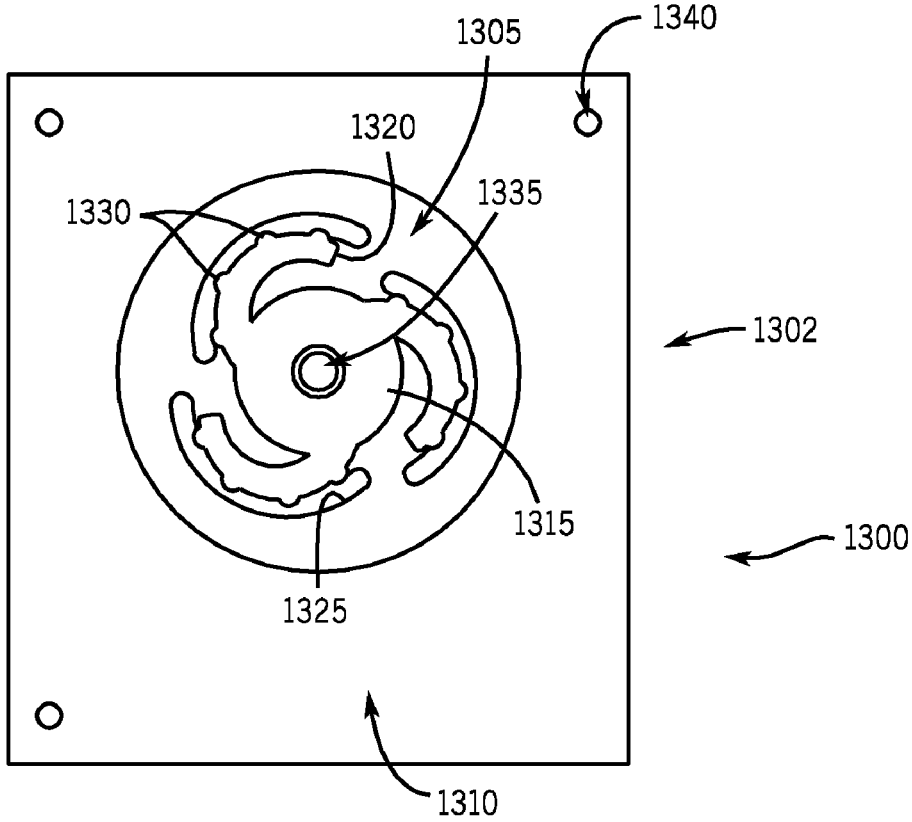
FIG. 14 shows a schematic diagram of yet another embodiment of a radiation control apparatus.

It should be understood that one or more features of the first layer 1102 shown in FIG. 12 can be integrated with one or more features of the second layer 1202 shown in FIG. 13. For example, FIG. 14 illustrates another embodiment of a printed circuit assembly 1300 that includes an integral layer 1302 comprising a core part 1305 and a peripheral part 1310, similar in construction to the first core part 1105 (FIG. 12) and the second peripheral part 1210 (FIG. 13) described above. The core part 1305 includes a central part 1315 electrically connected to radial extensions 1320, and slots 1325 coupled to the longitudinal extensions 1330, similar in construction to the central part 1115, extensions 1120 and 1126, and slots 1125 shown in FIG. 12 and described above. The central part 1315 generally surrounds a conduit 1335, similar to the conduit 1135 described above. The peripheral part 1310 includes PPTHs 1340, similar to the PPTHs 1230 described above. The central part 1315 and extensions 1320 and 1330 are generally spaced in electrical isolation from the electrically conductive medium of the peripheral part 1310 by electrically non-conductive, insulating substrate material of the core part 1305.

Figure 15:
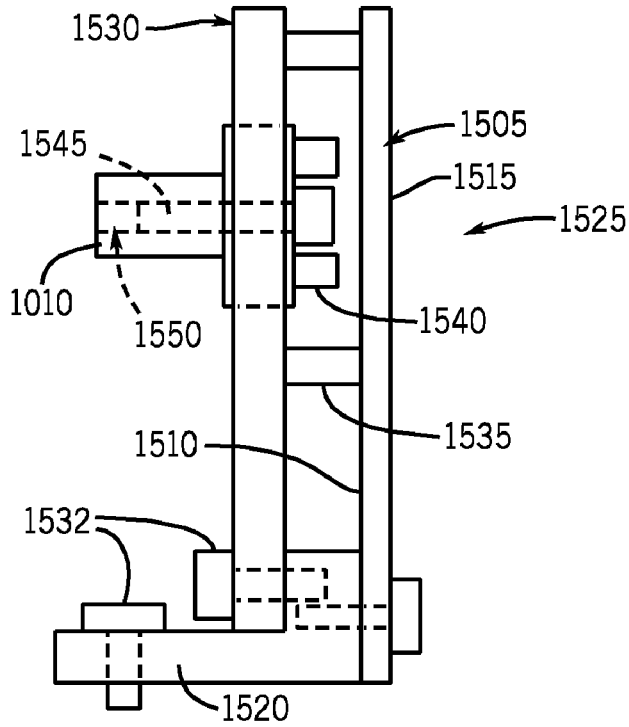
FIG. 15 shows a schematic diagram of an embodiment of a radiation control apparatus that includes a multiplier circuit board in combination with a printed circuit board assembly.

FIG. 15 shows a schematic diagram of another embodiment of a radiation control apparatus 1525. The radiation control apparatus 1525 generally includes a multiplier circuit board 1505 in combination with a printed circuit board assembly 1530, similar to the radiation control apparatus of 900 of FIG. 9. The multiplier circuit board 1505 generally is mounted by multiple electrical components 906 of the multiplier circuit 908 (See FIG. 9) electrically connected as part of or in addition to the power supply circuit 1004 (See FIG. 10), similar to the multiplier circuit board 905. The multiplier circuit board 1505 in combination with the power supply circuit 1004 of FIG. 10 is operable to generate amplified high voltage potentials to the radiation source 1002 of the radiation generator 1000. One embodiment of the multiplier circuit board 1505 comprises a solder side 1510 and a component side 1515. The component side 1515 is configured to be mounted by the multiple electrical components 906 of the multiplier circuit 908 (See FIG. 9). The solder side 1510 being the opposite side of the component side 1515 can be configured to face the printed circuit board assembly 1530.

Still referring to FIG. 15, the anode 1010 of the radiation source 1002 (See FIG. 10) is mounted at and supported in a cantilevered fashion from the printed circuit board assembly 1530 so as to fix a desired location of the focal spot of the radiation generated by the radiation source 1002 (See FIG. 10). The multiplier circuit board 1505 is fixedly attached adjacent to the printed circuit board assembly 1530 to provide additional mechanical strength to the cantilevered support of the anode 1010 (See FIG. 10).

As illustrated in FIG. 15, the construction of the multiplier circuit board 1505 in combination with the printed circuit board assembly 1530 is compact so as to reduce possibilities of miscellaneous bending stresses associated with the cantilevered support mounting from influencing undesired movement of the anode 1010 and respective location of the focal spot of the radiation source 1002 (See FIG. 10). The typical dimension of the multiplier circuit board 1505 is in the range of 60 mm to 70 mm, with a thickness in the range of 2.4 mm. The printed circuit board assembly 1530 is generally placed in parallel alignment relative to the multiplier circuit board

1505. The dimension of the printed circuit board assembly 1530 can be generally proportional to the dimension of the multiplier circuit board 1505 such that an overall thickness of the printed circuit assembly 1530 is about 3.2 mm.

The illustrated radiation control apparatus 1525 can further include a metallic leg 1520 in combination with one or more fasteners 1532 (e.g., threaded bolt and nut) that attaches the printed circuit board assembly 1530 at the multiplier circuit board 1505. The rigidity of the metallic leg 1520 facilitates accurate positioning of the radiation control apparatus 1525 so as to enhance locating a desired fixed position of the focal spot. Moreover, the metallic leg 1520 can be used for providing an electrical ground connection to the multiplier circuit board 1505 and/or the printed circuit board assembly 1530. One or more spacers 1535 can be located to maintain uniform separation between the multiplier circuit board 1505 and the printed circuit board assembly 1530, similar to, the spacers 930. The radiation control apparatus 1525 can further include an electrical connector (e.g., a berg stick connector) between the multiplier circuit board 1505 and the printed circuit board assembly 1530.

Still referring to FIG. 15, the space between the multiplier circuit board 1505 and the printed circuit board assembly 1530 is configured to receive an external heat sink 1540 mounted at the printed circuit board assembly 1530 and in attachment to the opposite side of the anode 1010. A mechanical fastener 1545 (e.g., a threaded bolt) extends through a conduit 1550 (similar to the conduit 1135 and 1235 described above and shown in FIGS. 10-13) and attaches the external heat sink 1540 and the anode 1010 to one another at the printed circuit board assembly 1530. An embodiment of the anode 1010 includes a threaded internal female adapter to receive the threaded mechanical fastener 1545. The external heat sink 1540 is configured to be selectively attached so as to increase the heat conductive medium for dissipating heat from the anode 1010 and the printed circuit board assembly 1530.

The multiplier circuit board 1505 is generally designed to supply the high voltage potential in tune with the voltage potential of the anode 1010, thereby decreasing the need for an insulation arrangement between the multiplier circuit board 1505 and the printed circuit board assembly 1530 as the first core part 1105 in the first layer 1102 (FIG. 12) of the printed circuit board assembly 1530 is maintained at the same voltage potential as that of the anode 1010. However, to reduce a likelihood of electric arc between the insert mounting area of the printed circuit board assembly 1530 and some point in the multiplier circuit board 1505, an insulating arrangement may be used between the printed circuit board assembly 1530 and the multiplier circuit board 1505. The insulating arrangement and the spacers 1535 provided between the multiplier circuit board 1505 and the printed circuit board assembly 1530 can be made of an insulating material comprising at least one polymeric material selected from the group consisting of thermoplastic elastomers, polypropylene, polyethylene, polyamide, polyethylene terephtalate, polybutylene terephtalate, polycarbonate, polyphenylene oxide, and blends of polypropylene, polyethylene, polyamide, polyethylene terephtalate, polybutylene terephtalate, polycarbonate, and polyphenylene oxide.

In another embodiment, one or more electrical components 906 (FIG. 9) forming a part of or in addition to the multiplier circuit 515 (FIG. 9) or the power supply circuit 1004 (FIG. 10) can be transferred to be mounted at the printed circuit board assembly 1530 (FIG. 15). The electrical components 906 can be, for example, a split resistor, a high voltage (HV) resistor divider, and diodes of variable value. The radiation control apparatus 1525 allows moving one or more electrical components of the multiplier circuit 515 and/or the power supply circuit 1004 from mounting at the multiplier circuit board 1505 to the printed circuit board assembly 1530. The shifting of electrical components from the multiplier circuit board 1505 to the printed circuit board assembly 1530 can reduce the spatial density and associated density of heat generation at the multiplier circuit board 1505, thereby improving the associated thermal efficiency of the radiation generator 1000 (see FIG. 1).

The above-described embodiments of radiation control apparatuses 1025 and 1525 simultaneously reduces, shields or controls emission or transmission of various types of electromagnetic radiation scatter while providing fixed mounting assembly for supporting the anode 1010 of the radiation source 1002 (e.g., x-ray tube). Although particular embodiments of the location of the radiation control apparatuses 1025 and 1525 are shown, the embodiments are not so limited and the location of the radiation control apparatus 1025 and 1525 relative to the radiation source 1002 can vary. Also, the embodiments of the radiation control apparatus 1025 and 1525 can be implemented in connection with different applications. The application of the radiation control apparatus 1025 and 1525 in controlling radiation scatter can be extended to other radiation generating systems, such as medical imaging systems, industrial inspection systems, security scanners, particle accelerators, etc.

In addition to the needs described above, the radiation control apparatus 1025 facilitates heat dissipation in a radiation generator 1000, provides a mount for miscellaneous electrical components, and enhances regulation of stray capacitance across the miscellaneous electrical components, which can be adapted to be employed with various types of radiation generators 1000. Hence the subject matter described herein provides a simple, compact, efficient, cost effective and manufacturer friendly construction of a radiation generator 1000. Furthermore, the above-described embodiments of the radiation control apparatus 1025 allow the use of well-controlled processes employed in manufacturing the insulating construction (e.g., epoxy-laminated glass sheet such as FR4, etc.) of the printed circuit board assembly 1030.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An apparatus to control transmission of an electromagnetic radiation generated by a radiation source of a radiation generator, the radiation source including an anode opposite a cathode, the apparatus comprising:

at least one printed circuit board assembly fastened at the anode of the radiation source, the printed circuit board assembly comprising at least one first layer that includes a conduit to receive a mechanical device attaching the anode at the at least one first layer.

2. The apparatus of claim 1, wherein the at least one first layer further comprises a first core part and a first peripheral part located radially outward and surrounding the first core part, the first peripheral part comprising a first substrate material selected from the group consisting of an epoxy laminated glass sheet, epoxy laminated paper, ceramic and polyimide.

3. The apparatus of claim 2, wherein the printed circuit board assembly further comprises at least one second layer bound to the first layer, the second layer comprising a second core part and a second peripheral part located radially outward relative to and surrounding the second core part.

4. The apparatus of claim 3, wherein the first core part comprises a central part comprised of an electrically conductive material.

5. The apparatus of claim 4, wherein the first core part further comprises a plurality of radial extensions integral with the central part, the radial extensions being finger-liked shaped and extending radially outward from the central part.

6. The apparatus of claim 5, wherein the first core part further comprises at least one slot coupled to one or more of the plurality of radial extensions.

7. The apparatus of claim 6, wherein the second core part includes at least one slot located in general longitudinal alignment with the at least one slot of the first core part.

8. The apparatus of claim 5, wherein the first core part comprises at least one longitudinal extension coupled in electrical connection to the radial extension, the longitudinal extension aligned perpendicular to the radial extension.

9. The apparatus of claim 8, wherein the central part and the plurality of radial extensions and the at least one longitudinal extension are comprised of a medium of electrically conductive material.

10. The apparatus of claim 3, wherein at least a portion of the second peripheral part in the second layer is printed with a medium of electrically conductive material.

11. The apparatus of claim 3, wherein the second core part comprises a second substrate material selected from the group consisting of an epoxy laminated glass sheet, epoxy laminated paper, ceramic and polyimide.

12. The apparatus of claim 3, further comprising an electrical component mounted at one of the first layer and the second layer.

13. A radiation generator, comprising:

a radiation source operable to generate an electromagnetic radiation, the radiation source comprising an anode;

a power supply circuit electrically coupled to provide electrical power to energize the radiation source; and a radiation control apparatus configured to reduce transmission of electromagnetic radiation generated by the radiation source, the radiation control apparatus comprising at least one printed circuit board assembly fastened at the anode of the radiation source, the printed circuit board assembly comprising at least one first layer that includes a conduit to receive a mechanical device attaching the anode at the at least one first layer.

14. The radiation generator of claim 13, wherein the mechanical device is one of a screw, a fastener or a connector.

15. The radiation generator of claim 13, wherein the printed circuit board assembly is aligned in a plane generally perpendicular to a longitudinal axis of the radiation source.

16. The radiation generator of claim 13, wherein the printed circuit board assembly includes a plurality of first layers laminated together and a plurality of second layers laminated together.

17. The radiation generator of claim 16, wherein each of the plurality of first layers comprise a first core part and a first peripheral part located radially outward relative to and surrounding the first core part, the first core part comprised of a different material relative to the first peripheral part.

18. The radiation generator of claim 16, wherein each of the plurality of second layers comprise a second core part and a second peripheral part located radially outward relative to and surrounding the second core part, the second core part comprised of different material relative to the second peripheral part.

19. The radiation generator (1000) of claim 17, wherein the first core part (1105) includes a central part (1115) comprised of an electrically conductive material printed on an electrically non-conductive material.

20. An X ray generator, comprising:

an X ray tube operable to generate electromagnetic radiation;

a power supply circuit electrically coupled to provide electrical power to energize the X ray tube; and a radiation control apparatus to reduce transmission of electromagnetic radiation generated by the X ray tube, the radiation control apparatus comprising at least one printed circuit board assembly fastened at an anode of the X ray tube, the printed circuit board assembly comprising at least one first layer that includes a conduit to receive a mechanical device therethrough attaching the anode at the at least one first layer.

* * * * *